US011345004B2

(12) United States Patent
Marxkors

(10) Patent No.: US 11,345,004 B2
(45) Date of Patent: May 31, 2022

(54) TOOL FOR INSERTING AND/OR REMOVING A WIRE THREAD INSERT

(71) Applicant: BÖLLHOFF VERBINDUNGSTECHNIK GmbH, Bielefeld (DE)

(72) Inventor: Andreas Marxkors, Hövelhof (DE)

(73) Assignee: Böllhoff Verbindungstechnik GmbH, Bielefeld (DE)

( * ) Notice: Subject to any disclaimer, the term of this patent is extended or adjusted under 35 U.S.C. 154(b) by 411 days.

(21) Appl. No.: 16/324,143

(22) PCT Filed: Jul. 14, 2017

(86) PCT No.: PCT/EP2017/067905
§ 371 (c)(1),
(2) Date: Feb. 8, 2019

(87) PCT Pub. No.: WO2018/028939
PCT Pub. Date: Feb. 15, 2018

(65) Prior Publication Data

US 2019/0176309 A1 Jun. 13, 2019

(30) Foreign Application Priority Data

Aug. 10, 2016 (DE) ..... 102016114824.5

(51) Int. Cl.
*B25B 27/14* (2006.01)
*B25B 23/14* (2006.01)

(52) U.S. Cl.
CPC ..... *B25B 27/143* (2013.01); *B25B 23/141* (2013.01); *B25B 27/14* (2013.01)

(58) Field of Classification Search
CPC ..... B25B 27/143; B25B 27/14; B25B 23/141; Y10T 29/53691; Y10T 29/49881
See application file for complete search history.

(56) References Cited

U.S. PATENT DOCUMENTS 1,651,413 A * 12/1927 Schule ..... H01K 3/04 216/100
2,747,449 A 5/1956 Metcalf
(Continued)

FOREIGN PATENT DOCUMENTS

CN 203875847 U 10/2014
CN 104284756 A 1/2015
(Continued)

OTHER PUBLICATIONS

English translation of the International Preliminary Report on Patentability for PCT/EP2017/067905 dated Feb. 12, 2019, (8 pages).
(Continued)

*Primary Examiner* — Tyrone V Hall, Jr.
*Assistant Examiner* — Makena S Markman
(74) *Attorney, Agent, or Firm* — Reising Ethington P.C.; Matthew J. Schmidt

(57) ABSTRACT

The disclosure relates to a tool for inserting or removing a wire thread insert. The spindle body inserted in the tool has a radial recess, through which an engaging end of the installation blade engages a wire thread insert. The radial recess has a curvilinear circumferential contour or at least one relief notch, which serve for mechanical tension relief in the spindle body.

8 Claims, 4 Drawing Sheets

(56) References Cited

U.S. PATENT DOCUMENTS

Figure 1:
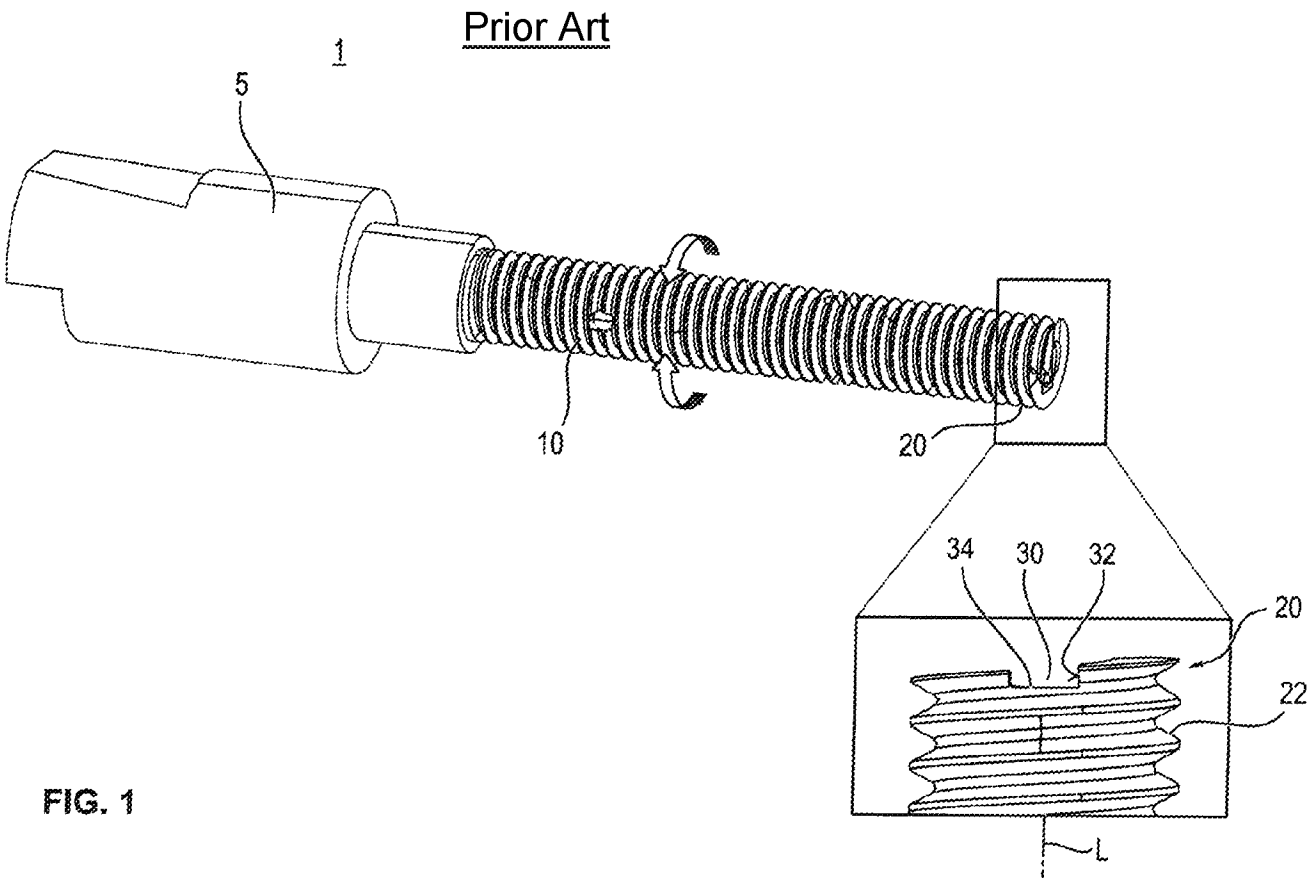

| | | | | |
|---|---|---|---|---|
| 4,077,101 | A * | 3/1978 | Wallace | B23P 6/00 29/240.5 |
| 4,227,290 | A * | 10/1980 | Wallace | B25B 27/143 29/240.5 |
| 4,536,115 | A * | 8/1985 | Helderman | B25B 27/143 411/17 |
| 4,553,303 | A | 11/1985 | Yamamoto | |
| 6,000,114 | A | 12/1999 | Newton et al. | |
| 8,850,680 | B2 * | 10/2014 | Marxkors | F16B 37/12 29/407.02 |
| 9,421,676 | B2 | 8/2016 | Hondo | |
| 9,719,546 | B2 | 8/2017 | Thommes et al. | |
| 9,764,454 | B2 | 9/2017 | Thommes et al. | |
| 10,391,567 | B2 | 8/2019 | Choi et al. | |
| 2015/0283688 | A1 * | 10/2015 | Szewc | B25B 27/143 29/456 |
| 2017/0021484 | A1 | 1/2017 | Szewc et al. | |
| 2017/0284444 | A1 | 10/2017 | Thommes et al. | |
| 2017/0284445 | A1 | 10/2017 | Thommes et al. | |
| 2017/0284446 | A1 | 10/2017 | Thommes et al. | |

FOREIGN PATENT DOCUMENTS

| | | | |
|---|---|---|---|
| CN | 106457492 | A | 2/2017 |
| DE | 3000368 | A1 | 11/1980 |
| DE | 102011051846 | A1 | 1/2013 |
| EP | 0153266 | A2 | 8/1985 |
| EP | 0153267 | A2 | 8/1985 |
| EP | 0153268 | B1 | 1/1990 |
| EP | 0615818 | A1 | 9/1994 |
| EP | 1838499 | B1 | 8/2008 |
| JP | S5821010 | A | 2/1983 |
| JP | H06170745 | A | 6/1994 |
| JP | 5933680 | B1 | 6/2016 |
| JP | 2016117123 | A | 6/2016 |
| KR | 880000556 | B1 | 4/1988 |
| KR | 1020160068442 | A | 6/2016 |
| WO | WO2012062604 | A1 | 5/2012 |
| WO | WO2013007498 | A1 | 1/2013 |
| WO | WO2015157165 | A2 | 10/2015 |

OTHER PUBLICATIONS

IN Office Action for IN Application No. 201927001903 dated Jun. 16, 2020 (6 pages).

KR Notice of Allowance for KR Application No. 10-2019-7004591 dated Jan. 22, 2021 (3 pages).

Written Opinion & International Search Report for PCT/EP2017/067905 dated Oct. 30, 2017, 10 pages.

CN Office Action for CN Application No. 201780048192.5 dated Mar. 17, 2020 (10 pages).

JP Office Action for JP Application No. 2019-506357 dated Mar. 24, 2020 (3 pages).

* cited by examiner

Prior Art

TOOL FOR INSERTING AND/OR REMOVING A WIRE THREAD INSERT

1. Technical Field

The present disclosure relates to a tool for installing or removing a wire thread insert, and a production method therefor.

2. Background

Various tools are known for installing or removing wire thread inserts in the prior art. Such tools comprise a spindle body that usually has a drive section, and a seat section with the thread for screwing on the wire thread insert. An installation blade is arranged in the interior of this spindle body. This installation blade is an elongated construction with a middle pivot point. This middle pivot point is also frequently the attachment point for the installation blade that is formed by a pin riveted in the spindle body. A contacting end is arranged at an end of the installation blade and engages in the wire thread insert. Frequently, a spring is arranged at the other end of the installation blade so that the contacting end is spring biased in an engaged position in the wire thread insert.

Such tools are described in EP 0 153 266, EP 0 153 267, EP 0 153 268 B1, EP 0 615 818 and DE 10 2011 051 846 B1.

In the aforementioned documents from the prior art, a contacting end of the installation blade contacts the wire thread insert through a radial recess in the spindle body. To this end, the wire thread insert has for example a corresponding notch. Once the tool is turned in the component opening to install or remove the wire thread insert, the tool's torque is transmitted by the contacting end of the installation blade to the wire thread insert. To ensure the stability of the contacting end of the installation blade, the contacting end generally abuts a radially arranged stop face of the spindle body. The stop face is tensioned by a radial longitudinal section parallel to the radius of the spindle body, and an axial longitudinal section parallel to the longitudinal axis of the spindle body.

It has been shown that these radially arranged stop faces are exposed to mechanical stress loads, in particular pressures on the stop face that exceed the mechanical stability of the material of the spindle body. These mechanical loads primarily act in a tangential direction relative to the spindle body. This is because the contacting end impacts the stop face with the force of the effective torque when installing and/or removing a wire thread insert. This repetitive, nearly cyclical load causes material fatigue and material failure in the region of the radial recess which disadvantageously shortens the life of the tool and generates maintenance costs. For this reason, this mechanical load causes damage to the spindle body adjacent to the contacting end of the installation blade after a certain time of use of the tool.

It is therefore an object of the present invention to provide a tool with a longer service life and less wear in comparison to the prior art.

3. SUMMARY

The above object may be achieved by a tool and a production method for this tool as set forth in this disclosure. Further embodiments and further developments are set forth in the following description, the accompanying drawings and the claims.

The tool for installing and/or removing a wire thread insert has the following features: A spindle body with a drive section and a seat section for a wire thread insert, wherein the seat section comprises a thread for screwing on, or a threadless surface for plugging on, the wire thread insert, an installation blade that is at least partially arranged in the spindle body and that comprises a contacting end with which the wire thread insert can be installed and/or removed by the installation blade, wherein the spindle body in the seat section has a radial recess in which the contacting end of the installation blade is at least temporarily arranged, and that comprises a curvilinear peripheral contour and/or at least one release notch for mechanically decreasing the stress in the spindle body.

As already discussed above, the radial recesses in the spindle body possess an angular shape for the contacting end of the installation blade to pass through. This is in the form of a window or an angular U-shaped section. This angular design of the radial recess in particular leads to mechanical stress peaks in the corner regions of the radial recess when the contacting end abuts the edges of the radial recess. These stress peaks overload the material of the spindle body due to the at least cyclical load during the use of the tool. These overload states cause a failure of the spindle body material in the region of the radial recess which causes crack growth, material damage and loss of strength in the spindle body material. According to an embodiment, angular contours are therefore not used to design this radial recess. Instead, the radial recess has a curvilinear peripheral contour. This curvilinear peripheral contour ensures that arising mechanical stresses are not concentrated at one point. Instead, these arising mechanical stresses are distributed across the available overall edge of the radial recess, for example as the contacting end abuts the edges of the radial recess. In this manner, these existing mechanical stresses are released to the spindle body over a larger area and thereby avoid overload states in the spindle body material.

According to another embodiment, at least one release notch is provided in the radial recess of the spindle body. This release notch also eliminates the angular contour of the radial recess. The release notch may extend transversely to the peripheral contour of the radial recess, and may be outside of the stop faces. In this manner, additional clearance is provided at the edge region of the radial recess in particular so that for example particularly stressed regions can yield to decrease mechanical stresses. Since stressed regions cannot be held by adjacent edge regions of the radial recess due to the release notch, the radial edge region of the recess adjacent to a release notch exploits the elastic material properties of the spindle body and decreases mechanical stress loads. Since the material stress that occurs here only uses the elastic material behavior and does not lead to plastic deformation, these mechanical stresses also do not cause a failure of the spindle body in the region of the radial recess.

According to a further embodiment, the radial recess has at least one radially arranged stop face against which the contacting end of the installation blade can abut when the spindle body is turned. According to another embodiment, the contour of the radial recess is formed in an arc outside of the at least one radial stop face. This arc shaped configuration serves to prevent corner regions in the radial recess that can lead to a concentration of mechanical stresses.

According to another embodiment, the at least one release notch represents a depression in the peripheral contour of the radial recess that is arranged outside of and preferably adjacent to the at least one contact face.

Based on practical experiences in the use of the installation and/or removal tool for wire thread inserts, it has been shown that the mechanical stresses of the spindle body on the at least one radial stop face of the radial recess are limited. In order to decrease the mechanical stresses that arise in this region, it may be preferred to arrange the at least one release notch adjacent to the radial stop face. In this manner, the radial stop face may be provided with additional clearance since the spindle body can escape elastically in the region of the radial recess.

To relieve the radial recess, the release notch may extend at least partially in the axial direction of the spindle body and has a straight or curvilinear shape. In this context, it also may be preferable for the at least one release notch to be designed as an arc, wherein in one direction, the arc runs away from the at least one adjacent stop face. This shape in particular is key in actually reducing mechanical stresses at the stop face. Moreover, with the assistance of this shape and the depth of the release notch, the spring behavior of the radial recess, in particular the stop faces as well as the mechanical stress curve within the spindle body are positively influenced, i.e., toward a reduction of stress.

According to another embodiment, at least one release notch is provided for each stop face of the radial recess.

The present disclosure moreover comprises a production method for a tool for installing and/or removing a wire thread insert that has the following steps: Producing a spindle body with a drive section and a seat section, wherein the seat section has a thread for screwing on, or a threadless surface for plugging on, the wire thread insert, creating a radial recess within the seat section that comprises a curvilinear peripheral contour and/or at least one release notch for mechanically decreasing the stress in the spindle body, and providing and arranging an installation blade in the spindle body such that a contacting end of the installation blade is at least partially arranged in the radial recess.

In another embodiment of the production method described above, it also may be preferable to provide the radial recess with at least one radially arranged stop face. Moreover, release notches may be provided with an axial extension relative to the spindle body that have a straight or curvilinear shape.

4. BRIEF DESCRIPTION OF THE ACCOMPANYING DRAWINGS

Figure 2:
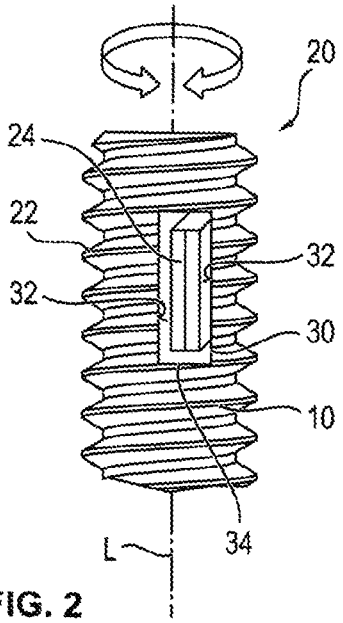
FIG. 2 Prior Art
Figure 3:
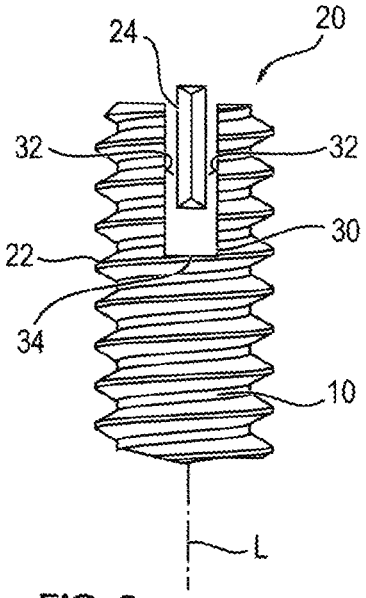
Figure 4:
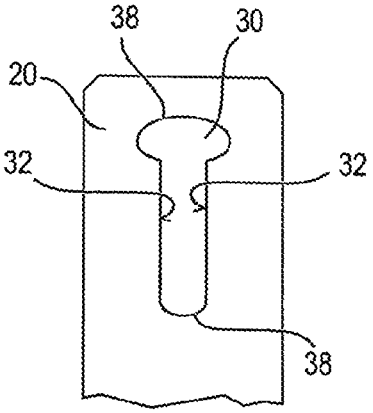
Figure 5:
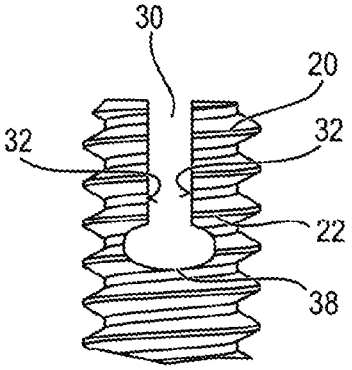
Figure 6:
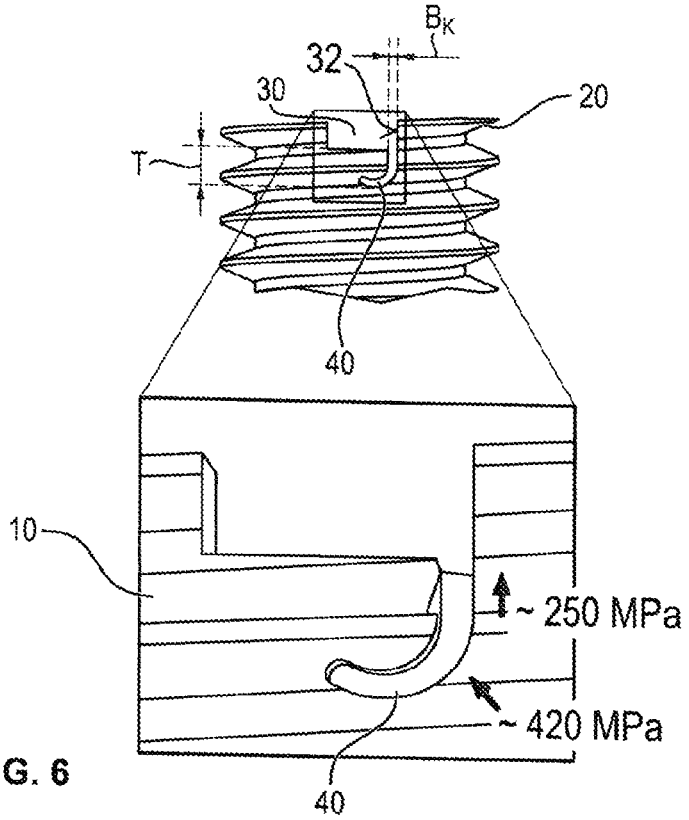
Figure 7:
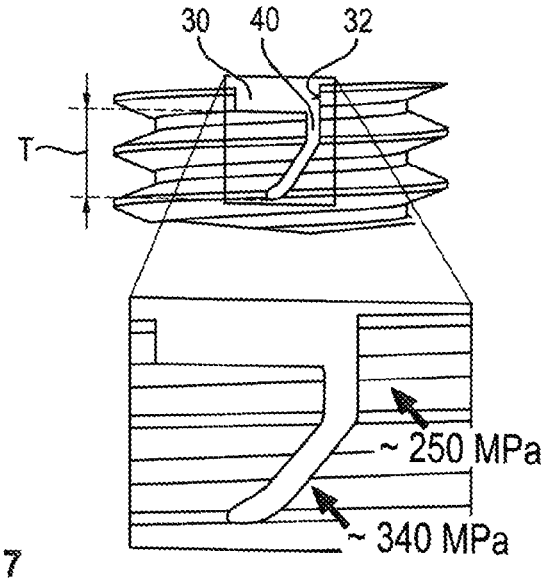
Figure 8A:
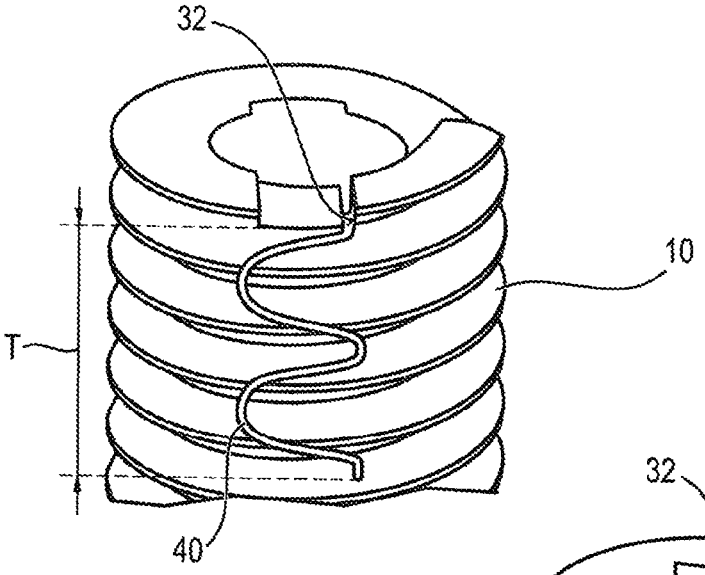
Figure 8B:
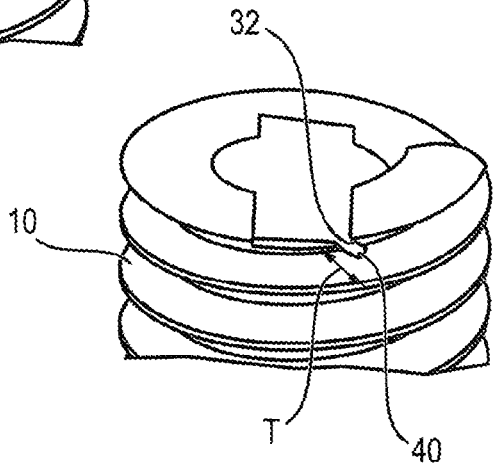
Figure 9:
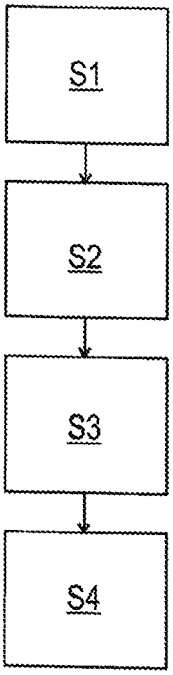

Some embodiments of the present disclosure are explained in greater detail with reference to the accompanying drawings. In the following:

FIG. 1 shows a tool for installing or removing a wire thread insert from the prior art with a radial recess, FIG. 2 shows a schematic representation of a seat section of a tool known from the prior art, FIG. 3 shows a schematic representation of the seat section of the tool according to FIG. 1 from the prior art, FIG. 4 shows an embodiment of the radial recess, FIG. 5 shows a further embodiment of the seat section of the tool, FIG. 6 shows a further embodiment of the seat section with a radial recess and release notch, FIG. 7 shows a further embodiment of the seat section with a radial recess and release notch, FIGS. 8*a* and 8*b* show additional embodiments of the release notch in the radial recess, and FIG. 9 shows a flowchart of an embodiment of the production method.

5. DETAILED DESCRIPTION

As discussed above, various tools are known for installing and removing wire thread inserts in the prior art. FIG. 1 shows an example of such a tool 1. The tool 1 comprises a spindle body 10 that can be automatically and/or manually turned by a drive section 5. FIG. 1 shows an embodiment of a drive section 5 that can be fastened in an appropriate chuck of a drive unit. To manually turn the tool 1, a bar or arm may be provided that is arranged transverse to the longitudinal axis L of the tool 1 (not shown).

The spindle body 10 has a seat section 20 for the wire thread insert (not shown) at an end opposite the drive section 5. The seat section 20 can be seen in the sectional enlargement in FIG. 1.

The seat section 20 comprises a thread 2 for rotating or screwing on the wire thread insert, or a threadless surface (not shown) for plugging on the wire thread insert.

Within the spring body 10, generally one axial cutout (not shown) is provided in which an installation blade (also not shown) is arranged. Such installation blades are known from the prior art, for example from DE 10 2011 051 846 B1, EP 1 838 499 B1, EP 0 153 267 B1, EP 0 615 818 A1 and WO 2012/062604, which are hereby incorporated by means of reference.

The installation blade has a contacting end 24 as shown by way of illustration in FIGS. 2 and 3. The contacting end 24 extends out of the interior of the spindle body 10 into a radial recess 30 in the spindle body 10, or beyond to the outside. Depending on the construction of the tool 1 known from the prior art and the arrangement of the installation blade in the spindle body 10, the contacting end 24 of the installation blade is arranged permanently or temporarily in the radial recess 30. In the spindle body 10, the installation blade is intentionally pivotable or tipable or generally movable. Proceeding therefrom, the contacting end 24 moves in the radial recess 30 depending on the design of the tool 1 in order to contact a wire thread insert. In the same manner, the contacting end 24 can be removed out of the radial recess 30 and into the interior of the spindle body 10. As a result, the contacting end 24 is arranged at least partially in the radial recess 30.

According to different embodiments of the present invention, the radial recess 30 possesses the shape of a window (see FIG. 2) so that its perimeter is bordered by the spindle body 10. According to another embodiment, the radial recess 30 is designed similar to a groove in the spindle body 10 that runs in the axial direction (see FIG. 3). It also may be preferable for the radial recess 30 (not shown) to represent an L-shaped surface when for example the tool is only used in one rotational direction. In this case, the L-shaped radial recess 30 would only provide a stop face 32 on one side. In general, the radial recess 30 represents an opening in the spindle body 10 in a radial direction, i.e., perpendicular to the longitudinal axis of the spindle body 10. This radial opening may have a certain width adapted to the size of the stop end 24, as well as a certain length parallel to the longitudinal axis of the spindle body 10.

The spindle body 10 is turned around its longitudinal axis L to install and/or remove a wire thread insert as indicated in FIG. 1-3 by the arrow D (direction of rotation). Once the contacting end 24 engages in a wire thread insert during this rotational movement, the contacting end 24 is pressed against one of the stop faces 32 of the radial recess 30 that are arranged opposite each other where it abuts. The radial recess 30 may comprise at least one stop face 32. If the tool is only used to install or only to remove wire thread inserts, only one stop face 32 in the installation direction, or respectively removal direction D, is sufficient. If contrastingly the tool 1 is used for installing and removing wire thread inserts, two stop faces 32 that are arranged opposite each other may be preferable.

A peripheral contour, or respectively a peripheral outline 34 of the radial recess 30 is designed angled in known tools as can be seen in FIG. 1-3. As a result of the shape, the stop face 32 for abutting the contacting end 24 when installing or removing a wire thread insert is bordered by two corner regions 36 in each case. These corner regions 36 generate mechanical stress peaks in the spindle body 10 during the use of the tool 1.

According to an embodiment, the radial recess 30 is equipped with roundings 38 in order to reduce the mechanical stress peaks. The roundings 38 are arranged in place of the corner regions 36. These roundings 38 are not angled and possess an arc-shaped (FIG. 4) or curvilinear contour. In this manner, mechanical loads at the stop faces 32 are deflected into the spindle body 10 without generating pressure peaks. It also may be preferable to design the roundings 38 in a bone shape. Such roundings 38 can be used both in a seat section 20 with (see FIG. 5) or without a thread 22 (see FIG. 4) as well as in a recess with a closed perimeter (see FIG. 4) or in a radial recess 30 (see FIG. 5) that is open on one side.

According to another embodiment, the radial recess 30 of the seat section 20 has at least one release notch 40. Different embodiments of the release notch 40 are portrayed in FIGS. 6 to 7. The shape of the release notch 40 is however not limited to the shown embodiments. Below, the release notch 40 will be explained with reference to the example of a grooved-shaped radial recess 30 and also applies in the same way to a radial recess 30 with a closed peripheral contour 34.

The release notch 40 is arranged adjacent to a stop face 32 in order to support the reduction and deflection of the mechanical stresses that arise there into the material of the spindle body 10. Accordingly, the release notch 40 may form a depression in and perpendicular to the peripheral contour 34 of the radial recess 30.

The at least one release notch 40 is also arranged in place of a corner region 36. In this manner, the rigid connection between the stop face 32 and a transverse surface 33 of the radial recess 30 is relieved by the release notch 40 to give the stop face 32 additional flexibility, or respectively freedom of movement in the context of the properties of the material of the spindle body 10. The release notch 40 therefore accordingly enables additional yielding of the stop face 32 relative to the mechanical loads from the contacting end 24. In this manner, mechanical stress peaks are displaced from the stop face 32 to the axial depth of the spindle body 10, i.e., to the closed end of the release notch 40.

In order to support the stability of the spindle body 10, a material may be preferred in combination with a specified hardness with respect to optimum crack insensitivity with low plastic deformation and good wear resistance. According to a further embodiment, a precipitation-hardening steel with a designation of 1.2709ESU with a preferred hardness within a range of 50 to 58 HRC, preferably 54 HRC is used. It also may be preferred to use martensite-hardening steel according to 1.2550 or 1.2767 ESU with 52 HRC. Alternatively, hard metal may be used as the spindle body material that has obtained its properties based on tailored sintering methods.

At least one release notch 40 is arranged on each stop face 32 or only adjacent to a selected stop face 32. It also may be preferable to provide one release notch 40 instead of each corner region 36 or only instead of selected corner regions 36. It therefore may be preferable to equip the closed radial recess 30 with one or with two release notches 40 per stop face 32. It also may be preferable to equip the open groove-shaped radial recess 30 with one release notch 40 per stop face 32.

The release notch 40 may run in the axial direction of the spindle body 10, at least along a portion of its length. This contour is straight or curvilinear, or represents a combination of sections of both contour shapes. Moreover, it may be preferable to have an initially straight axial contour transition into an arc-shaped section. In this case, it has proven to be advantageous when one end of the arc faces away from the stop face 32 (see FIGS. 6 and 7).

With reference to the comparison of FIGS. 6 and 7, it is also discernible that the release notch 40 may have a j-like shape (see FIG. 6), or a comma-like shape (see FIG. 7).

Independent of the shape of the release notch 40, it has been shown using the embodiments of the present disclosure that a reduction of the mechanical stress on the release notch 40 and hence the material of the spindle body 10 occurs as the depth T of the release notch 40 increases in the axial direction of the spindle body 10. This is discernible with the aid of the exemplary stress values in FIGS. 6 and 7. At a depth T of approximately one thread pitch in FIG. 6, a mechanical reduction of stress to 420 MPa is achieved. At a depth T of approximately 1.5 thread pitches in FIG. 7, a mechanical reduction of stress to approximately 340 MPa is achieved. It accordingly may be preferred to furnish the release notch 40 with as great a depth as possible. The depth T may have a value from the range of $0.5 \cdot ST \leq T \leq 4 \cdot ST$, more preferably from $1.0 \cdot T \leq T \leq 3.5 \cdot ST$ and in particular $T = 1.5 \cdot ST$, wherein ST designates the pitch of the thread of the spindle body. The release notch 40 may start at the base of the thread and ends at the tip of the thread. The release notch 40 may have a width $B_K$ over the course of the peripheral direction of the spindle body 10 within a range of $0.15\ mm \leq B_K \leq 0.5\ mm$, preferably $B_K = 0.3\ mm$.

FIG. 8*a, b* shows examples of other contours of release notches 40. Accordingly, the release notch 40 in FIG. 8*a* extends in a curvilinear contour up to a depth of $T = 3.5 \cdot ST$. Here as well, a slight depth may be preferred when the mechanical loads on the stop face 32 permit it. FIG. 8*b* shows a release notch 40 that is angled toward the stop face 32.

In a production of the tool 1 (see FIG. 9), first the spindle body 10 is produced with the drive section 5 and the seat section 20 in step S1. Then in step S2, the radial recess 30 is created within the seat section 20. The radial recess 30 then has at least one of the above-described shape features for mechanically relieving stress.

In another method step S3, the spindle body 10 with the radial recess 30 and release notch 40 or rounding 38 is blasted with a blasting medium. The blasting medium may be accelerated by means of compressed air and directed toward the outer surface of the spindle body 10. In this manner, body edges of the spindle body 10 may be rounded and/or the surface of the spindle body 10 is compressed. Abrasive medium and nonabrasive medium is suitable as the blasting medium. Examples of blasting medium are sand, sandblasting medium, corundum, plastic and/or chilled casting or cast steel. A slight plastic deformation of the surface of the spindle body 10 may be achieved with preferred glass pearls. This may create intrinsic stress in the spindle body 10 which increases the surface hardness and the long-term strength.

Then in step S4, the installation blade, which may be like the installation blade shown in FIGS. 2 and 3, is provided and arranged in the spindle body 10 in step S4 so that the contacting end 24 of the installation blade is arranged in the radial recess 30. It also may be preferable for at least one of the radial stop faces 32 to be provided in the radial recess 30 in the context of the production method. It moreover may be preferable to provide the release notch 40 discussed above with an axial extension relative to the spindle body 10 such that it has a straight or curvilinear shape.

The invention claimed is:

1. A tool for at least one of installing and removing a wire thread insert, wherein the tool has the following features:

a. a spindle body with a drive section and a seat section for a wire thread insert, wherein the spindle body defines a longitudinal axis, the seat section comprises a thread for screwing on, or a threadless surface for plugging on, the wire thread insert, and an axial cutout is provided within the spindle body in the direction of the longitudinal axis, b. an installation blade that is at least partially arranged in the axial cutout of the spindle body and that comprises a contacting end with which the wire thread insert can be at least one of installed and removed by the installation blade, wherein c. the spindle body has a radial recess in the seat section in which the contacting end of the installation blade is at least temporarily arranged, wherein the radial recess represents an opening in the spindle body in a radial direction being perpendicular to the longitudinal axis of the spindle body, and d. the radial recess has at least one radially arranged stop face against which the contacting end can abut when the spindle body is turned and comprises one or both of the following:

d1. a curvilinear peripheral contour formed in an arc outside of the at least one radially arranged stop face, and d2. at least one release notch for mechanically decreasing the stress in the spindle body.

2. The tool according to claim 1, wherein the radial recess comprises the at least one release notch and the at least one release notch represents a depression in the peripheral contour of the radial recess that is arranged outside of the at least one radially arranged stop face.

3. The tool according to claim 1, wherein the radial recess comprises the at least one release notch and the at least one release notch extends at least partially in the axial direction of the spindle body and has at least one of a straight and a curvilinear shape.

4. The tool according to claim 1, wherein the radial recess comprises the at least one release notch and the at least one release notch extends at least partially in the axial direction of the spindle body and is formed in an arc, wherein in one direction, the arc runs in a direction away from the at least one radially arranged stop face.

5. The tool according to claim 1, wherein at least one release notch is provided for each radially arranged stop face.

6. A production method for a tool for at least one of installing and removing a wire thread insert, wherein the production method has the following steps:

a. producing a spindle body with a drive section and a seat section, wherein the spindle body defines a longitudinal axis, the seat section has a thread for screwing on, or a threadless surface for plugging on, the wire thread insert, and an axial cutout is provided within the spindle body in the direction of the longitudinal axis, b. creating a radial recess within the seat section, wherein the radial recess represents an opening in the spindle body in a radial direction being perpendicular to the longitudinal axis of the spindle body, has at least one radially arranged stop face against which a contacting end of the installation blade can abut when the spindle body is turned and comprises one or both of a curvilinear peripheral contour formed in an arc outside of the at least one radially arranged stop face, and at least one release notch for decreasing the mechanical stress in the spindle body, c. providing and arranging an installation blade in the axial cutout of the spindle body so that the contacting end of the installation blade is at least temporarily arranged in the radial recess.

7. The production method according to claim 6, wherein the radial recess comprises the at least one release notch, which is provided with an axial extension relative to the spindle body that has a straight or curvilinear shape.

8. The production method according to claim 6, with the further step:

the spindle body is blasted with at least one of an abrasive and a nonabrasive blasting medium to improve the lifetime of the spindle body.

* * * * *